US005586398A

United States Patent [19]

Carlson

[11] Patent Number: 5,586,398

[45] Date of Patent: Dec. 24, 1996

[54] ARTICLE OF FOOTWEAR FOR MORE EFFICIENT RUNNING

[76] Inventor: J. Martin Carlson, 6005 Kellogg Ave., Edina, Minn. 55424-1830

[21] Appl. No.: 542,682

[22] Filed: Oct. 13, 1995

Related U.S. Application Data

[63] Continuation of Ser. No. 183,360, Jan. 19, 1994, abandoned.

[51] Int. Cl.[6] ..... A43B 5/00

[52] U.S. Cl. ..... 36/114; 36/143; 36/9 R; 36/129; 36/43

[58] Field of Search ..... 36/9 R, 142, 143, 36/144, 114, 129, 127, 43, 44, 59 R, 51; 2/239

[56] References Cited

U.S. PATENT DOCUMENTS

| | | | |
|---|---|---|---|
| D. 258,547 | 3/1981 | Famolare, Jr. | D2/309 |
| D. 307,212 | 4/1990 | Aveni | D2/320 |
| 338,201 | 3/1886 | Stelle | 36/9 R |
| 349,562 | 9/1886 | Blum | 36/9 R |
| 787,226 | 4/1905 | Smith | 36/9 R |
| 1,214,666 | 2/1917 | Ford . | |
| 1,301,228 | 4/1919 | Clark | 36/9 R |
| 1,803,554 | 5/1931 | Knilans | 36/9 R |
| 2,018,710 | 8/1932 | Elkin | 36/43 |
| 2,135,725 | 11/1938 | Merritt | 36/25 R |
| 2,147,197 | 2/1939 | Glidden | 36/3 A X |
| 2,211,057 | 8/1940 | Duckoff | 36/103 |
| 2,235,256 | 3/1941 | Elliott | 36/34 |
| 2,543,183 | 11/1948 | Maling | 36/19.5 |
| 2,586,045 | 2/1952 | Hoza | 36/9 R |
| 2,616,190 | 11/1952 | Darby | 36/144 |
| 3,009,270 | 11/1961 | Nacht | 36/28 |
| 3,071,877 | 1/1963 | Stickles | 36/44 |
| 3,169,327 | 3/1964 | Fukuoka | 36/34 |
| 3,416,174 | 12/1968 | Novitske | 36/9 R X |
| 3,804,099 | 4/1974 | Hall | 128/583 |
| 4,041,619 | 8/1977 | Sapper | 36/25 R |
| 4,149,274 | 4/1979 | Garrou et al. | 2/239 |
| 4,155,180 | 5/1979 | Phillips | 36/129 |
| 4,180,924 | 1/1980 | Subotnick | 36/129 |
| 4,224,749 | 9/1980 | Diaz-Cano | 36/35 R |
| 4,228,549 | 10/1980 | Rispoli | 2/239 |
| 4,261,061 | 4/1981 | McAlvage | 2/239 |
| 4,425,721 | 1/1984 | Spronken | 36/11.5 |
| 4,535,554 | 8/1985 | De Obaldia | 36/113 |
| 4,557,059 | 12/1985 | Misevich et al. | 36/32 R |
| 4,578,882 | 4/1986 | Talarico, II | 36/103 |
| 4,617,745 | 10/1986 | Batra | 36/3 B |
| 4,644,669 | 2/1987 | Greco | 36/9 R |
| 4,679,334 | 7/1987 | McBride | 36/114 |
| 4,722,144 | 2/1988 | Beerli | 36/117 |
| 4,817,303 | 4/1989 | Selbiger | 36/51 X |
| 4,852,273 | 8/1989 | Hamy | 36/28 |
| 5,154,682 | 10/1992 | Kellerman | 36/44 |

FOREIGN PATENT DOCUMENTS

| | | | |
|---|---|---|---|
| 0386770 | 9/1990 | European Pat. Off. | 36/143 |
| 1676582 | 9/1991 | U.S.S.R. | 36/129 |

*Primary Examiner*—Paul T. Sewell
*Assistant Examiner*—Ted Kavanaugh
*Attorney, Agent, or Firm*—Westman, Champlin & Kelly, P.A.

[57] ABSTRACT

An article of footwear (10) having an initial contact portion (30) and a medial/forefoot portion (34). The initial contact portion (30) exterior sole surface is formed at a dihedral angle (38) to the sole surface of the medial/forefoot portion (34) such that the heel portion has a minimal thickness of material interposed between the foot (32) and the ground surface (40) at a postero-lateral edge of the sole structure, which means that foot flight continues until the foot moves closer to the ground (40) to delay impact and increase stride length. A high friction interface (72,172) is provided in a medial/forefoot portion of a shoe insole and low friction interface (74,174) is provided at the initial contact portion (30) of the shoe insole. The low friction area (72) reduces shearing on foot impact, and the high friction forefoot interface (72,172) eliminates sliding of the forefoot during foot push-off, to decrease wasted energy. Energy efficient and stride length increase are achieved.

10 Claims, 5 Drawing Sheets

ARTICLE OF FOOTWEAR FOR MORE EFFICIENT RUNNING

This is a Continuation of application Ser. No. 08/183,360, filed Jan. 19, 1994 now abandoned.

BACKGROUND OF THE INVENTION

The present invention relates, in general, to an article of footwear for running and walking, and more particularly, to an article of footwear wherein the contour of the outer sole structure produces an increase in stride length and wherein there is reduced shearing, joint and bone trauma, and reduced muscle and tendon strain associated with the initial portion of each foot contact with a ground surface.

The interaction of the article of footwear or shoe with a ground surface during the stance phase of a gait cycle may be discussed in terms of events and stages. "Initial contact" is when a portion of the outer sole contacts the ground surface after the entire shoe has advanced forward during swing phase. Initial contact creates substantial force on the foot along the area of ground impact. "Foot-flat" is defined as that point when virtually all of the outer sole substantially comes to rest on the ground surface. "Heel-off" is when the heel area of the outer sole begins its rise off the running surface. It is generally agreed that the push-off stage of stance phase is roughly associated with the period between heel-off and "toe-off". "Toe-off" is when the forefoot portion of the outer sole leaves the ground surface to begin the swing phase of a gait cycle. Stride length is the distance between the point of toe-off of one foot and the heel at initial contact of the other foot.

One of the significant problems with conventional running shoes is that the ground-engaging surface of the sole is essentially flat and terminates in a relatively sharp edge along both the lateral and heel borders of the sole in the region of initial contact. The added material (which is generally the thickness of the sole) between the ground surface and the runner's foot reduces stride length by prematurely ending foot flight and creates an artificial fulcrum and leverage which promotes an unstable landing and which causes the foot to pronate and plantar-flex abruptly between initial contact and foot-flat. The increased joint action or movement velocities and accelerations/decelerations cause significantly increased impact muscle strain, and loadings on bones and joints of the extremity, especially those of the foot and ankle.

Conventional running shoes provide a substantially uniform frictional interface between the runner's sock and the shoe insole which is not efficient in terms of stride length, shearing trauma on foot impact, and wasted energy during push-off. A uniform high friction interface results in tissue shear trauma to plantar areas of initial contact, while a uniform low friction interface results in the foot sliding backward in the shoe during push-off, thereby wasting energy.

SUMMARY OF THE INVENTION

The present invention relates to an article of footwear having a sole divided into an initial contact portion and what is called the medial/forefoot portion. The initial contact portion is formed at a dihedral angle to the medial/forefoot portion such that the initial contact portion has a minimal thickness of material interposed between the foot and the ground surface at, or along, the area of initial contact of the sole structure. The minimal thickness of material in that area delays the instant of initial contact, compared to that of conventional shoes, thereby allowing a longer length of foot flight and correspondingly increased stride length. The dihedral angle is selected to match both an anterior-posterior angle and a medial-lateral angle between the foot and ground surface at the instant the sole structure impacts the ground surface. This angle varies from person to person and between different types of running and walking gaits.

The thickness of the sole may be varied in selected regions to increase performance.

The present invention also relates to a friction management system which reduces the shear trauma to the soft tissues of the foot and reduces wasted "push-off" energy by selectively managing the friction between different portions of the plantar skin surface of the foot and the shoe insole. There is a high friction relationship between the foot plantar surface and shoe insole in a medial/forefoot portion and a low friction relationship in the initial contact portion. The high friction medial/forefoot interface eliminates backward sliding of the forefoot within the shoe between heel-off and toe-off ("push-off") to decrease the amount of energy wasted in frictional sliding. The low friction relationship in the initial contact area provides a small amount of low friction slide between the foot and the insole on impact of the shoe with the ground surface. The result is an increase in stride length and reduced soft tissue shearing trauma on foot impact.

This invention envisions several ways to accomplish the aforementioned friction management. Friction could be managed by selective lubrication. It could also be managed by a judicious choice of materials, surface coatings, or surface treatments designed to affect friction across any one or more of the possible interfaces between foot plantar surface and shoe insole. Those possible interfaces would be skin/insole, skin/sock, inner sock layer/outer sock layer, and sock/insole. For example, an insole material might be selected which has a low coefficient of friction with a common sock material. However, friction is managed by coating or otherwise treating the medial/forefoot portion of the surface in a way that produces a relatively high coefficient of friction between that portion of the insole surface and the aforementioned sock material.

In one form of the invention a forefoot or a heel strap or both may be added to an open shoe construction for controlling slide of a foot in the shoe and to return the shoe to a neutral position during swing phase.

DETAILED DESCRIPTION OF THE PREFERRED EMBODIMENTS

Figure 1:
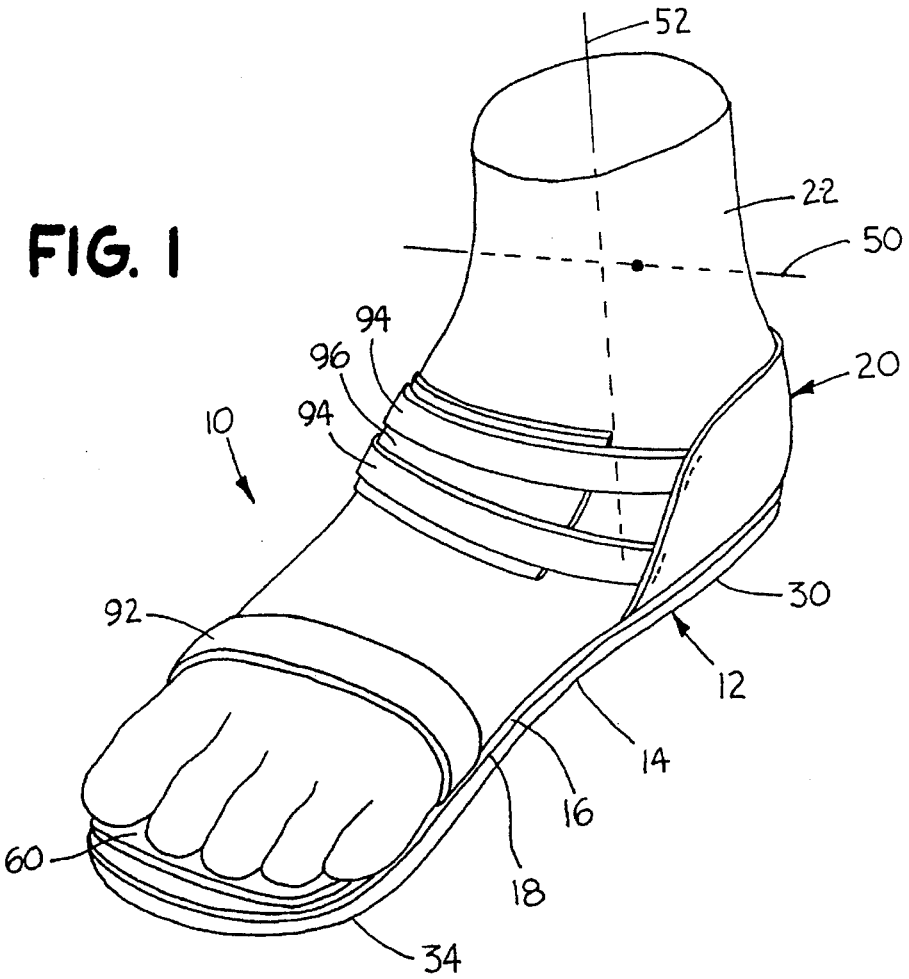
FIG. 1 is a perspective view taken from the left-side of a left shoe made according to the present invention.

Referring to FIG. 1, an article of footwear or a shoe 10 constructed for more efficient running or walking includes a sole structure 12 having a ground engaging surface 14 and an insole top surface 16, an insole 18, and an upper 20. The shoe 10 is designed to increase efficiency by increasing the stride length "L" in a persons gait, reduce trauma and strain on the skin, tissue, bones, joints, muscles, tendons, and ligaments of a foot 22 at initial contact and shortly thereafter including the foot-flat position and by reducing wasted energy of foot sliding within the shoe between heel-off and toe-off. The present invention is described with respect to a left shoe. However, it is to be understood that the same construction but in mirror image is intended for a right shoe and that the right and left shoes are intended to be worn as a pair for running and walking.

Referring to FIGS. 1, 2, 5, and 8, the ground engaging surface 14 of the sole structure 12 includes an initial-contact surface portion 30 and a medial/forefoot portion 34. The initial-contact surface portion 30 is a generally planar surface formed at a dihedral angle "α" relative to the plane of the surface of the medial/forefoot portion 34. The initial-contact surface 30 and medial/forefoot portion surface 34 join along dihedral line 38 between surface portions 30 and 34. The initial-contact surface portion 30 has a minimal thickness of material "T" interposed between the foot 22 and the ground surface at the point where the foot tends to first present itself for impact with a ground surface 40. The minimal thickness "T" allows a slight time delay in initial-contact on each stride, because the foot stays in flight until it comes closer to the ground than with a thicker sole at that aforementioned point. The stride length is thereby increased for each gait cycle. The increase in stride length of the present shoe 10 compared to a prior art shoe 11 (shown in phantom in FIG. 5) is reflected by the equation: $\Delta L=\Delta T \cot \theta$, where $\Delta L$ is the increase in stride length for a given person, $\Delta T$ is the effective reduction of the thickness of heel/sole material between the foot and the ground surface effected by the present shoe 10 having the initial contact surface portion 30 at a dihedral angle compared to the shoe 11 not having a dihedral angled initial contact surface. θ is the angle of trajectory of the shoe 10 at the moment of initial contact (See showing in FIG. 5). The smaller the angle of trajectory, the greater the increase in stride length since the foot 22 will be airborne for a longer period of time. The magnitude of the dihedral angle and, hence, the particular extent and position of the initial contact surface area depends on the angular position of the ankle axis 50, and the angular position of the sub-talar joint (inversion), at the moment of initial-contact. The extent of the initial contact surface also depends on the thickness of the medial/forefoot portion of the shoe sole.

The nature and extent of the bevel of the initial-contact surface portion 30 has a direct effect on the magnitude of the plantarflexion moment M and pronation moment M' created between initial contact and foot-flat portions of gait. Those moments can cause undesirable lower extremity joint, ligament, tendon, and muscle trauma. More specifically, the ground reaction forces at the moment of initial contact create a plantarflexion moment M about the ankle reflected by the equation: $M=F\times d$, where M is the ankle plantarflexion moment, F is the ground reaction force at the heel, and d is the right angle distance from the ankle rotation axis 50 to the line of action of the ground reaction force F (See FIG. 5). The plantarflexion moment M exists in varying magnitude continuously between initial contact and foot-flat position. During this time, the plantarflexion motion is controlled by an input of force by the ankle dorsiflexor muscles (principally the anterior tibialis) thereby creating a counter balancing dorsiflexion moment. The effort which the dorsiflexor muscles are required to expend from initial contact to foot-flat is reduced by reducing M. Changing the configuration of the heel by providing the initial contact surface portion 30 at a dihedral angle makes the ground reaction force F more anterior (forwardly), reducing d which thereby reduces the magnitude of M. Note that, as stated earlier, the distance F is moved forward, is a function of sole thickness along the dihedral line in addition to the magnitude of the dihedral angle. So this invention provides very significant means to reduce moment M. The dorsiflexor energy which would have been expended counterbalancing M. The dorsiflexor energy which would have been expended counterbalancing M becomes available for other muscles.

In like manner, the ground reaction forces at the moment of initial contact create a pronation moment M' about the sub-talar joint reflected by the equation: $M'=F\times d'$, where M' is the sub-talar pronation moment, F is the ground reaction force, and d' is the right angle distance from the sub-talar rotation axis 50A to the line of action of the ground reaction force F (See FIG. 8). The pronation moment M' exists in varying magnitude continuously between initial contact and foot-flat. During this time, pronation motion is controlled by an input of force by the foot inventer muscles thereby creating a counter balancing inversion moment. The effort which the invertor muscles are required to expend from initial contact to foot-flat positions is reduced by reducing M'. changing the configuration of the postero-lateral sole and heel by providing the initial contact surface portion 30 at a dihedral angle makes the ground reaction force F more medial (toward the center) reducing d', which thereby reduces the magnitude of M'.

In most cases, a person's weight load on a foot during a gait cycle proceeds in a lateral to a medial direction and in a heel to toe direction. Thus, the dihedral angle α of the bevel surface portion 30 is created by a posterior-lateral removal (or absence) of material reflecting the angle of inversion of the foot 22 as well as dorsiflexion/plantarflexion ankle position at the moment of impact. The dihedral angle α of the initial contact surface portion 30 should be about equal to or slightly less than the angle β between the medial/forefoot surface portion and the horizontal running surface (ground) at the time of impact. If α is greater than β, impact will be slightly earlier in that stride and a bit of stride length will be sacrificed, but the advantage of this design relationship of the angles is that ground reaction force F at initial-contact is more anterior (and medial) which reduces the work of dorsiflexor (and likewise invertor) muscles and spreads the impact energy to a greater area of the foot. It should be noted that the angles α' and β' are the frontal plane components of α and β. Likewise α" and β" are the parasagital plane components of α and β respectively.

Since the medial/lateral and posterior/anterior aspects of the dihedral angle α vary from person to person and from gait to gait, each shoe 10 is preferably custom designed for a particular person and for a particular gait. Alternatively, the shoe 10 may be manufactured according to a standard or generic foot-to-surface trajectory angle for a particular activity and for particular classes of people or gaits.

In terms of the angular position of the ankle axis 50 at the moment of initial contact, the greater the dorsi-flexion of the foot 22 the smaller the initial contact surface portion 30 and the greater the dihedral angle $\alpha$ needed in order to maintain the minimum thickness at the posterior edge of the surface portion 30. The most efficient dihedral angle $\alpha$ is selected to match both an anterior/posterior angle $\beta''$ and a medial/lateral angle $\beta'$ between the foot 22 and the ground surface 40 at the instant the initial contact surface portion 30 impacts the ground surface 40. This configuration reduces the plantarflexion moment to the point where the foot 22 no longer snaps as forcefully into plantarflexion and pronation after the initial contact. Thereby the strain and foot trauma between initial contact and foot-flat is reduced.

The dihedral line 38 formed by the junction of the initial contact surface portion 30 and the medial/forefoot surface portion 34 runs from the posterior-medial to the anterior-lateral portion of the sole structure 12. The dihedral line 38 acts as a fulcrum for shifting the runner's weight between initial contact and foot-flat position. It is anticipated that there would be an advantage to rounding the crest or junction created at dihedral line 38.

FIGS. 3A–3E are a series of cross sections each illustrating the lateral/medial slope of the sole structure 12 at different fore and aft positions at the moment of initial contact when the initial contact surface portion 30 is in full contact with the ground surface. As much of the postero-lateral portion of the heel nd sole of the shoe as possible should be removed from the sole structure 12 by cutting, grinding, or by molding to a particular design to minimize the distance (material) between the foot sole engaging surface 16 and the ground engaging surface 14 of the sole structure 12 under that portion of the foot which presents itself for first ground contact.

Figure 2:
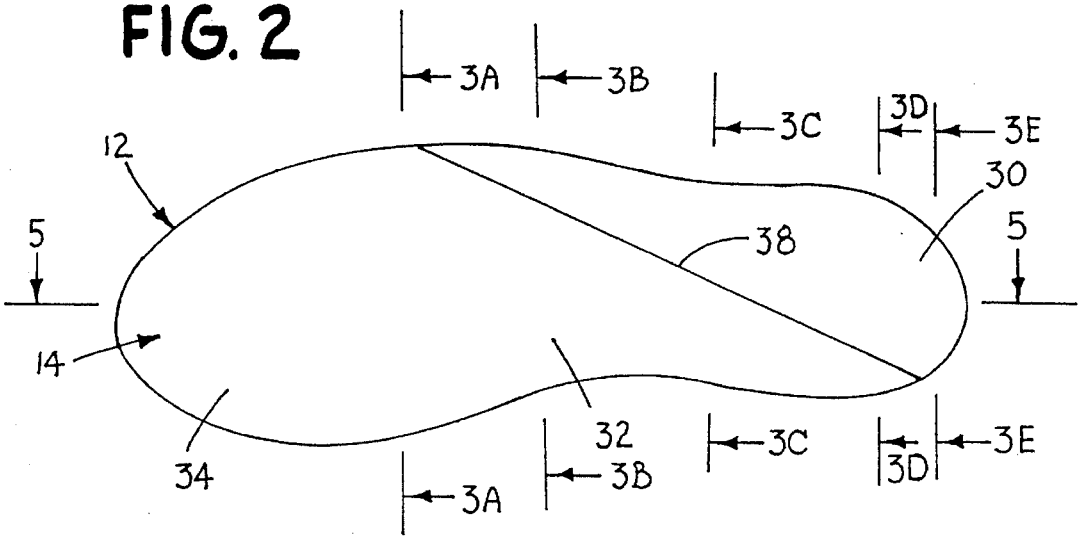
FIG. 2 is an example of our possible bottom plan view of a left sole for a shoe made according to the present invention.
Figure 3A:
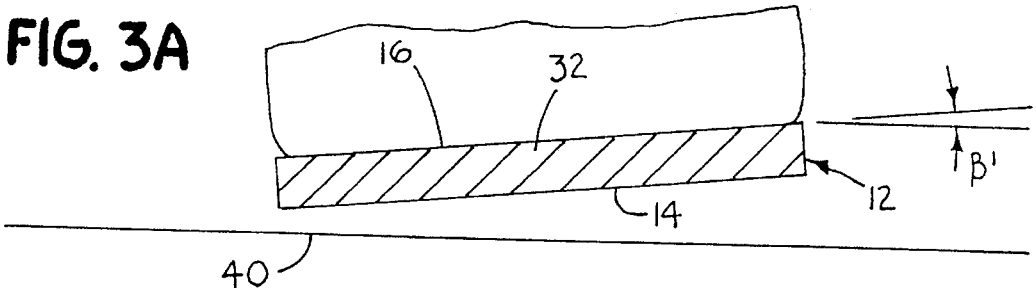
FIGS. 3A–3E relate to the moment of initial contact, and are sectional views taken generally along lines 3A—3A through 3E—3E of FIG. 2 respectively.
Figure 3B:
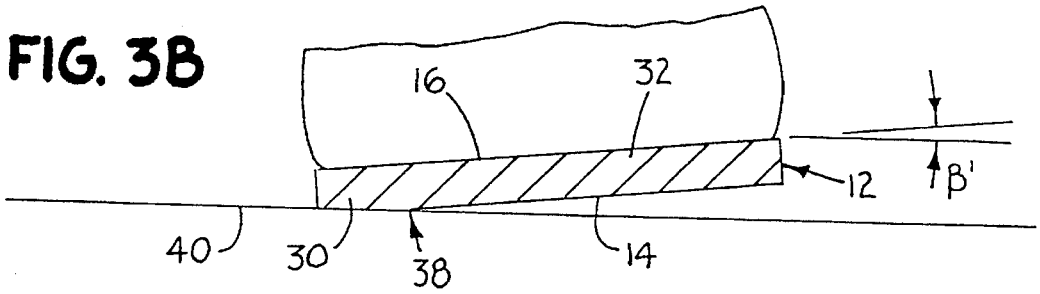
Figure 3C:
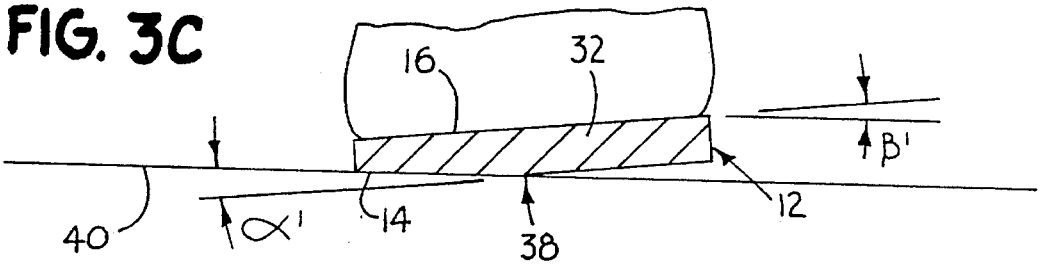
Figure 3D:
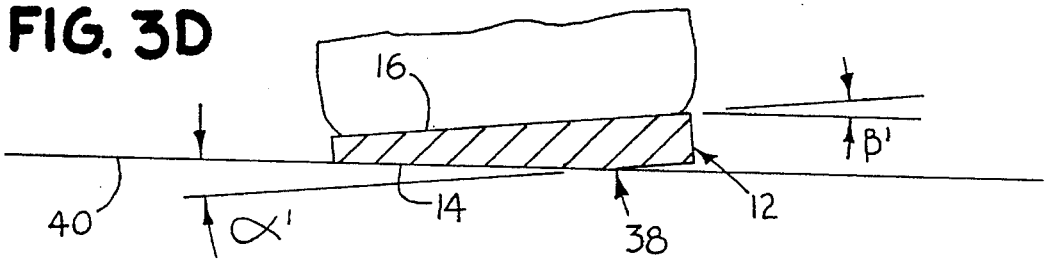
Figure 3E:
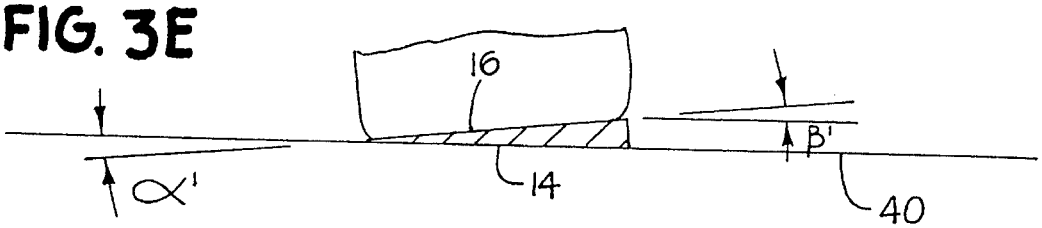

FIG. 3A illustrates the sole structure 12 thickness of the medial/forefoot portion 34 of the sole structure 12 (which is not yet in contact with the ground surface. The medial/forefoot portion 34 of the shoe sole 12 has a constant thickness between the ground engaging surface 14 and the foot 22 selected so that the sole structure 12 is flexible enough to bend between heel-off and toe-off. FIGS. 3B–3D illustrate the sole structure 12 thickness at selected cross sections along the dihedral line 38 wherein postero-lateral portions of the sole structure 12 are beveled away. The cross section locations are illustrated in FIG. 2 and are taken looking anteriorly/forwardly.

In the illustrated embodiment the area of minimal thickness is at the postero-lateral border of the heel portion 30 of the sole structure 12 (FIG. 3E) illustrating the case when the wearer is a postero-lateral heel striker. However, when running, the initial landing position of the foot 22 (or initial contact foot strike as it is called) varies for different running styles and for different speeds (e.g. sprinting, running, walking, etc.). For example, a classical runner (referred to as a heel striker) lands on the postero-lateral border of the foot. Other runners (referred to as midfoot strikers) make initial ground contact at the lateral midsole portion 32 and a few runners (referred to as straight heel strikers) will land, without any inversion, on the back of the heel. Although the present invention is described with respect to a classical heel striker in which the initial contact area is beveled in the posterior lateral portion, it is intended that the sole structure 12 be beveled in a medial/lateral aspect and/or a posterior/anterior aspect corresponding to wherever the first ground engaging contact occurs. For classical midfoot strikers the bevel would be lateral, while for straight heel strikers only the heel would be beveled.

Preferably, the thickness of the medial/forefoot portion of the sole becomes progressively thicker in a posterior-to-anterior direction. This is not shown in the illustrations. The incline of the insole structure 12 caused by the foregoing sole thickness variation puts the ankle plantarflexor muscle group at a slightly greater length at the moment of heel-off, thereby providing a greater spring or push off action. An insole with a toe ledge 60 or slightly raised platform positioned under the toes puts the toe flexor muscles at a greater length thereby additionally increasing the spring or push off action of the foot.

The forefoot portion 34 of the sole structure 12 is preferably constructed of a flexible, energy storing material to decrease wasted energy between heel-off and toe-off. As the heel rises from the ground surface 40 after foot-flat, the sole structure 12 bends in the area under the metatarsal heads of the foot 22 and the toes go into extension. Providing an energy storing material (having a strong elastic resistance) in the forefoot portion 34 of sole structure 12 provides thrust as the toes flex back towards their neutral position during the toe-off from the ground surface.

Initial contact during running, jogging or walking represents an impact shock against the underside of the tuberosity of the calcaneus and/or the lateral aspect of the plantar surface and the skin/tissue covering. The impact shock contains components both perpendicular to and parallel to the skin surface. The shear component of initial contact can be as traumatic as the perpendicular component. At initial contact the forward progress of the shoe 10 is suddenly halted. The foot/heel slides forward inside the shoe 10 an amount which depends on the fit, snugness, and friction between the skin of the heel and the insole 18. Minimizing the friction between the heel and insole 18 minimizes the tissue shear trauma. In fact, a small friction-free forward sliding of the heel on the insole 18 just after heel strike effectively lengthens the stride by that much. However, if friction was eliminated over the entire plantar surface, the runner would slide backward in the shoe 10 as he or she proceeded to "thrust" between heel-off and toe-off. Thus, friction between the initial contact area of the foot 22 and the insole 18 of the shoe 10 should be minimized, but friction between the metatarsal heads (and toes) and the shoe 18 insole should be maximized. Any forward slide in the shoe 10 occurring just after initial contact should be reversed during the next following swing phase.

Figure 4:
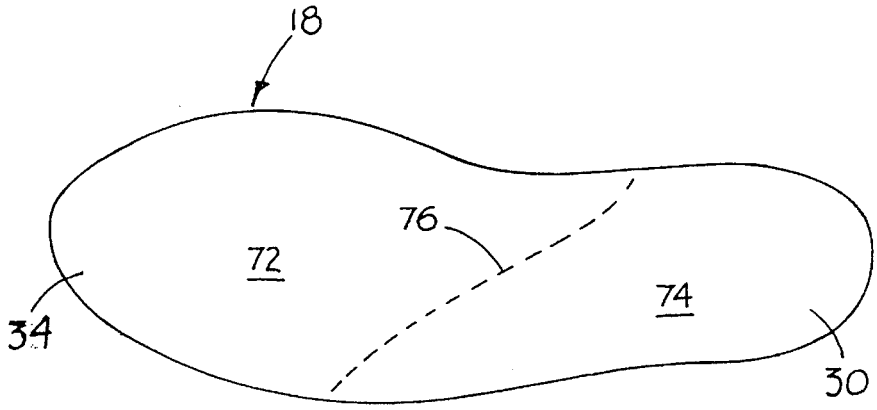
FIG. 4 is a top plan view of the left insole structure of FIG. 2 with the shoe upper broken away.

Referring to FIGS. 4, the shear component of tissue trauma is reduced by providing a friction management system at the shoe/foot interface which manages friction between the plantar skin surface of the foot 22 and the shoe insole 18 such that there is a high friction interface 72 in the medial/forefoot portion 34 of the insole 18 and a low friction interface 74 in the initial contact surface portion 30 of the insole 18. The low friction heel portion 30 provides a controlled slide between the foot 22 and the insole 18 on impact of the foot 22 with the ground surface 40 to increase stride length and reduce shearing trauma on foot impact. The high friction area 72 eliminates sliding of the forefoot within the shoe 10 during foot push-off to decrease wasted energy. Preferably, the friction management system of FIG. 4 is structured to allow a desired short amount of slide at and just after initial contact followed by a definite stop effectuated by the shoe upper 20 on the dorsal area of the foot 22. Also, weight bearing during the weight bearing phase of a gait moves not only posterior to anterior, but also from lateral to medial. Therefore, the transition from the low friction interface 74 to the high friction interface 72 is preferably along a diagonal or S-shaped line 76 from the medial posterior to the lateral anterior of the shoe structure 12. Note that the general angle of that interface ideally may be varied according to the initial-contact angles β' and β".

Figure 5:
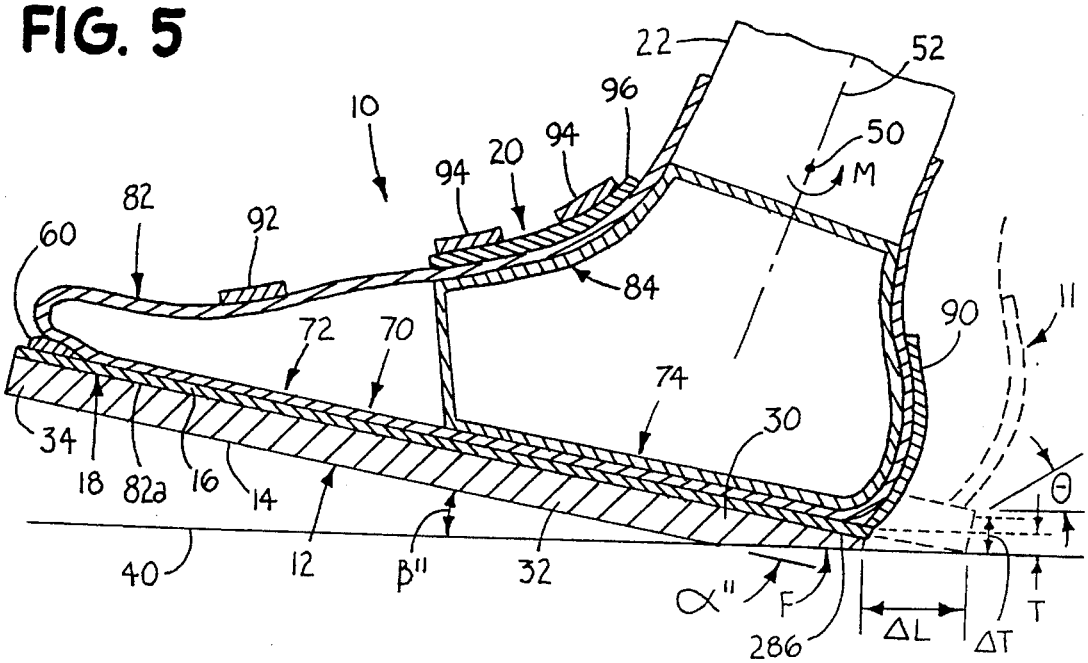
FIG. 5 is a sectional view taken generally along line 5—5 of FIG. 2, showing a first friction management interface between the left foot and the insole.

Referring to FIG. 5, a first embodiment of the friction management system 70 includes a full sock 82 constructed of a first material having a medial-forefoot portion 82*a* and a lateral heel portion 82*b*, and a heel insert 84 constructed of a second material and operable with the heel portion 82*b* of the full sock 82. The second material of the heel insert 84 has a low coefficient of friction with the first material of the first sock 82 such that the heel insert 84 slides within the full sock 82 at heel strike. The first material of the full sock 82 has a high coefficient of friction with both skin and the insole 18 or insole covering layer (not shown) to prevent sliding. However, the low friction interface 74 of the heel insert 84 within the full sock 82 allows the foot 22 to slide forward approximately ⅜ of an inch to reduce shear trauma on foot impact. The high friction interface 72 in the forefoot portion 34 of the shoe 10 eliminates sliding of the forefoot during push-off to decrease wasted energy. The low friction interface 74 between the heel insert 84 and the full sock 82 depends on the weave tightness or other fabric qualities in addition to the material type combinations such as cotton, rayon, nylon, etc. The full sock 82 and heel insert 84 could be separate items worn together or they could be a single unit stitched together (or joined by other means) at either the distal or proximal ends or both borders of the heel insert 84. This friction management system is, of course, preferably not just a heel/forefoot combination. It should be managed in a diagonal fashion to provide low friction for the entire initial contact area and high friction for the medial/forefoot area.

Figure 6:
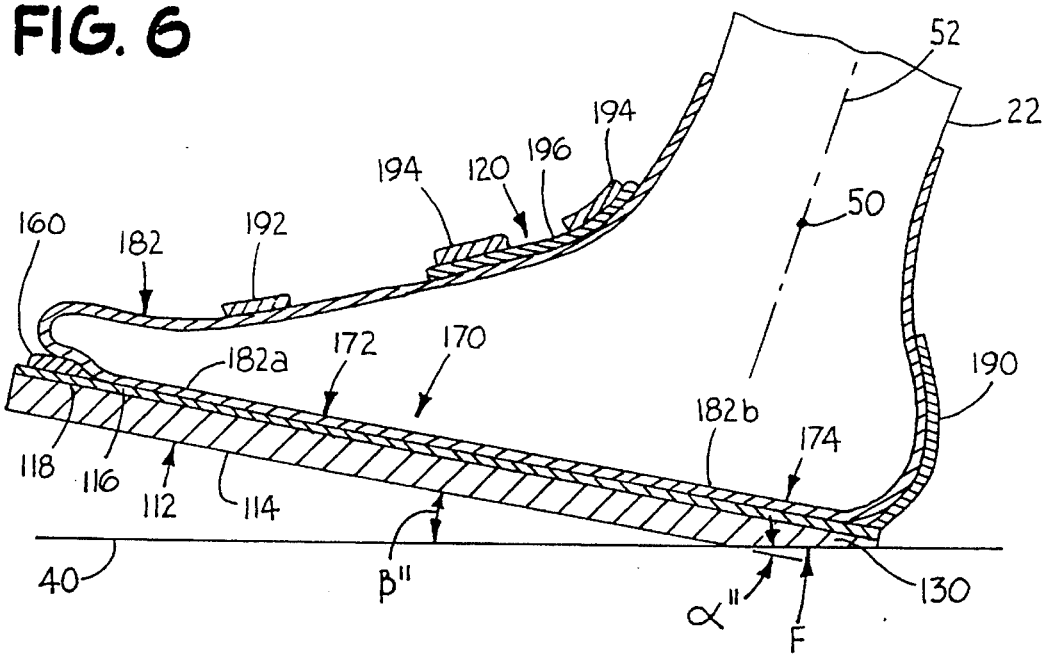
FIG. 6 is a sectional view similar to FIG. 5 showing a second friction management interface between the left foot and the insole.
Figure 7:
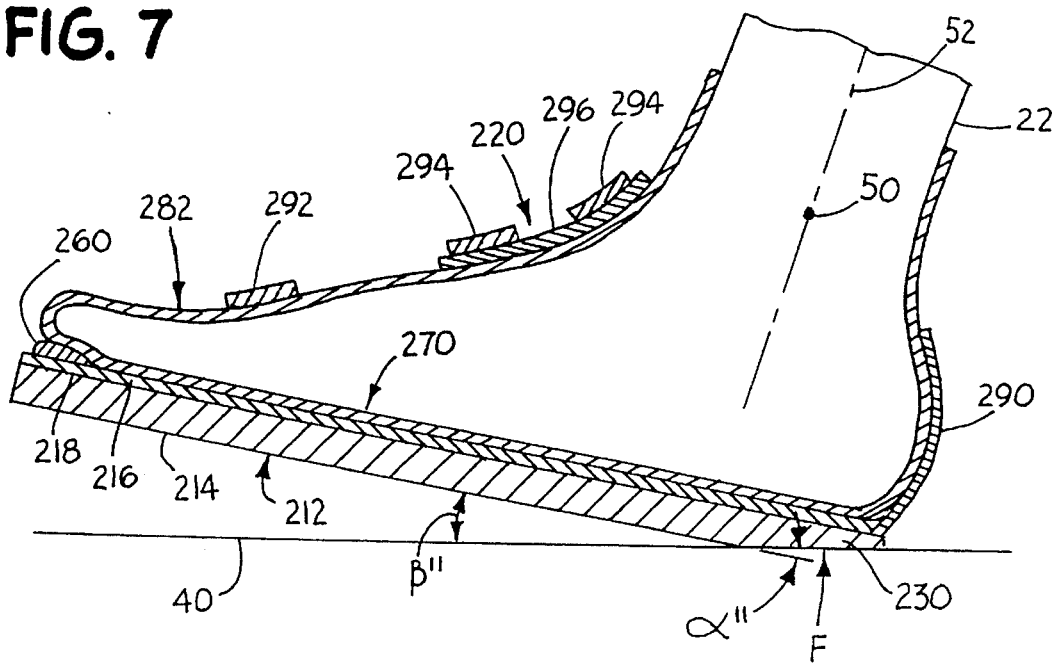
FIG. 7 is a sectional view similar to FIG. 5 showing a third friction management interface between the left foot and the insole.
Figure 8:
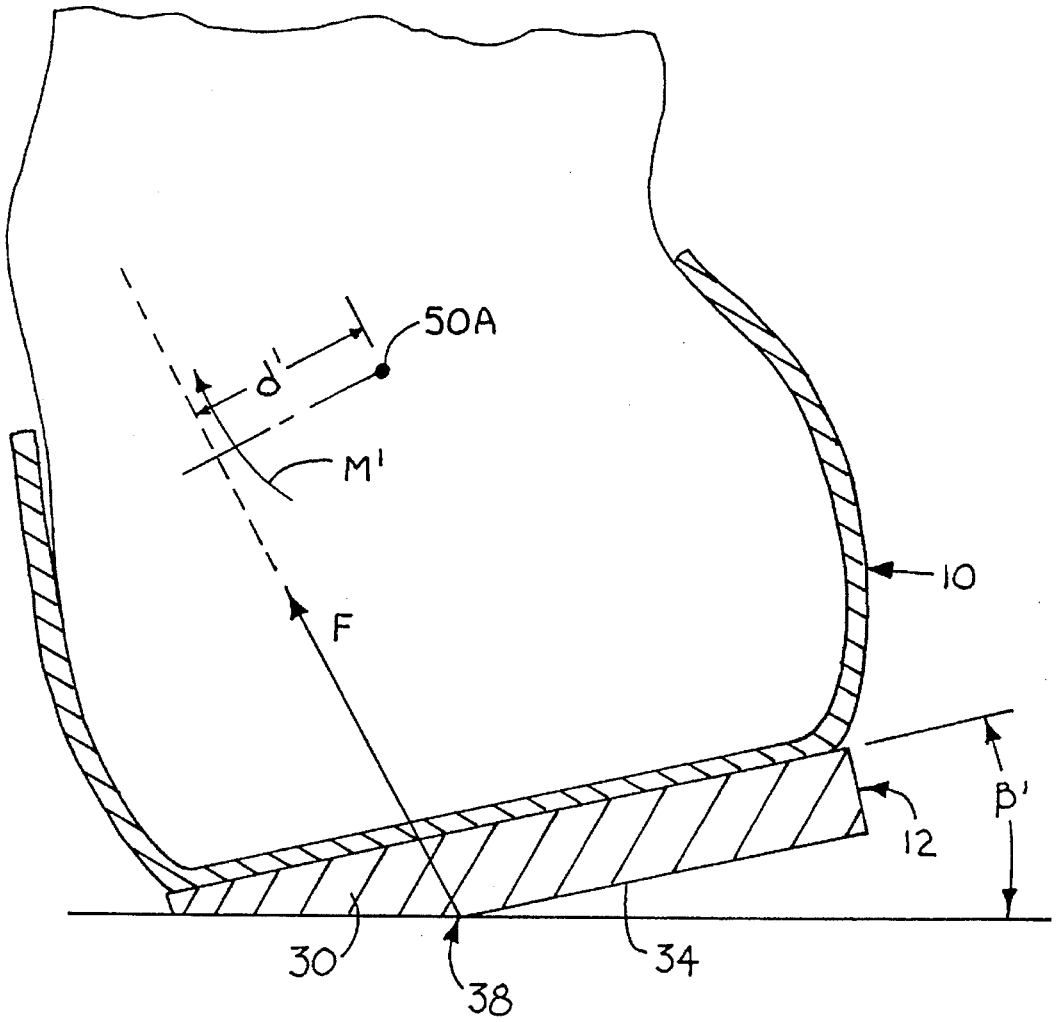
FIG. 8 is a schematic sectional view taken through a sub-talar rotation axis of a foot in a shoe made according to the present invention illustrating forces and moments on a sub-talar joint at moment of initial contact.

Other exemplary embodiments of the present invention are illustrated in FIGS. 6 and 7. The various elements illustrated in FIGS. 6 and 7, which correspond to elements described above with respect to the embodiment illustrated in FIGS. 1–5, are designated by corresponding reference numerals increased by one hundred and two hundred, respectively. All additional elements illustrated in FIGS. 6 and 7 which do not correspond to elements described above with respect to FIGS. 1–5 are designated by odd reference numerals. Unless otherwise stated, the embodiments of FIGS. 6 and 7 operate in the same manner as the embodiments of FIGS. 1–5.

Referring to FIG. 6, a second embodiment of the friction management system 170 includes an insole 118 which is constructed of a first material, and a sock 182 having a forefoot portion 182*a* constructed of a second material and a heel portion 182*b* constructed of a third material. The second material of the forefoot portion 182*b* has a high friction interface 172 with the first material of the insole 18, and the third material of the heel portion 182*a* has a low friction interface 174 with the insole 118 or insole covering layer (not shown) such that the heel portion 182*b* of the sock 182 slides approximately ⅜ of an inch within the shoe between initial contact and foot-flat 110 while the forefoot portion 182*a* does not slide during push-off.

Referring to FIG. 7, a third embodiment of the friction management system 270 is illustrated. The friction management system 270 includes a sock 282 constructed of a first material, and an insole 218 or insole covering layer (not shown) having a medial/forefoot portion 282*a* constructed of a second material and an initial contact portion 282*b* constructed of a third material. The second material of the medial/forefoot portion 282*a* has a high friction interface 274 with the first material of the sock 282 and the third material of the initial contact portion 282*b* has a low friction interface 272 with the first material of the sock 282 such that the heel portion 282*b* slides approximately ⅜ inch with the shoe 210 at heel strike. The materials may be selected for low and high interface friction 272 and 274 with a specially designed sock or the materials may be selected for use with socks made of common sock construction materials (e.g. cotton).

Friction management can be done by other methods also. The insole surface against which the foot and sock bear could be varied, coated or otherwise treated to create a high friction area 74 (FIG. 4) and low friction area 72. Also the sock material could be varied, coated or otherwise treated to create the aforementioned areas of high friction and low friction between foot and insole.

Referring to FIG. 1, the shoe upper 20 includes a heel cup 90, a forefoot strap 92 and a heel strap 94. The forefoot strap 92 and heel strap 94, which are partially constructed of a resilient material, extend across the dorsum of the foot 22 allow the foot 22 to slide forward within the shoe 10 at initial contact, and transmit a sufficient force to the foot dorsum after initial contact necessary to stop the forward slide of the foot 22 within the shoe 10. The forefoot strap 92 and heel strap 94 prevent the foot 22 from wedging in the forefoot portion of the shoe 10. In other words, the resilient material of the straps 92 and 94 allows the shoe 10 to return to the "neutral" position (wherein the foot 22 is in the maximum posterior position in the shoe 10) on the foot 22 at some point between toe off and the following initial contact (during the swing phase). The open structure of the shoe upper 20 prevents the foot 22 from wedging in the forefoot portion of the shoe in a tight manner which would prevent the return of the shoe to the neutral position. The heel straps 94 are anchored to the heel cup 90 and are perpendicular to the foot dorsum to prevent sliding thereon. The heel straps 94 are attached to a cushioned pad 96 which is positioned across the foot dorsum to prevent shearing trauma to the foot 22. The forefoot strap 92 is a resilient elastic to prevent tight wedging of the foot 22 in the forefoot portion of the shoe 10 as the foot 22 slides forward at initial contact and shortly thereafter. The heel cup 90 is a rigid material firmly fastened to the heel portion 30 of the sole structure 13.

If the shoe upper 20 is completely enclosed, the covering material should be attached in a slack manner so as not negate the characteristics of the aforementioned straps. Other structures may be used to provide a stoppage of the slide such as a deformable and resilient structure of the shoe upper without the deliberate use of the elastic components.

The "low friction" and "high friction" conditions are, as well known, achieved by having a low coefficient of friction between mating surfaces, at selected areas, and a high coefficient of friction between other selected areas.

Although the present invention has been described with reference to preferred embodiments, workers skilled in the art will recognize that changes may be made in form and detail without departing from the spirit and scope of the present invention.

What is claimed is:

1. An article of footwear having an anterior end portion and a postero-lateral portion comprising:

a sole structure having a postero-lateral initial contact portion and an medial/forefoot portion;

the initial contact portion having a substantially planar lower surface joining the medial/forefoot portion along a junction line, and the initial contact portion having a thickness tapering from the junction line to a postero-lateral edge of the sole structure to provide a minimum thickness of material interposed between a foot of the wearer and the ground engaging surface; and an insole having an insole initial contact portion and an insole medial/forefoot portion, the insole initial contact portion overlying the initial contact portion of the sole structure and being formed of material having a surface of a selected coefficient of friction for controlling slippage, and the insole medial/forefoot portion having a higher coefficient of friction which is higher than the selected coefficient of friction in the initial contact portion of the insole, to permit initial sliding between the foot and the insole in the insole initial contact portion on impact of the foot with the support surface, and the insole medial/forefoot portion reducing sliding of the forefoot relative to the insole.

2. The article of footwear as in claim 1, including in combination a full sock constructed of a first material having a medial/forefoot portion and an initial contact portion, and a half sock constructed of a second material and engaged with the heel portion of the full sock, the second material having a minimum coefficient of friction with the first material.

3. The article of footwear as in claim 2, wherein the full sock and the half sock are constructed as a single unit.

4. The article of footwear as in claim 1, and in combination a sock wearable by a user and constructed of a first material, and wherein the insole initial contact portion is constructed of a second material and the insole medial/forefoot portion is constructed of a third material, the second material having a low interface friction with the sock, and the third material having a higher interface friction with the sock.

5. The article of footwear as in claim 1, further comprising the insole being constructed of a first material, and a sock used in combination with the sole structure having the initial contact portion constructed of a second material and the medial/forefoot portion constructed of a third material, the second material having a low coefficient of friction interface with the insole, and the third material having a high coefficient of friction interface with the insole.

6. The article of footwear as in claim 1, further comprising a shoe upper having a resilient material extending across a foot dorsum for allowing the foot to slide within the article of footwear and for transmitting sufficient resilient force to the foot dotsum necessary to stop the forward slide of the foot within the article of footwear the resilient material acting to return the foot to a neutral position with respect to the sole structure during a swing phase of the selected gait.

7. The article of footwear as in claim 6, wherein the resilient material includes a cushioned pad positioned adjacent the foot dorsum and an elastic strap connecting the cushioned pad to the sole structure.

8. The article of footwear as in claim 6, wherein the resilient material limits forward sliding of the foot to between one-quarter inch and one-half inch after initial contact.

9. A running shoe for increasing the stride length in a selected gait cycle of a runner, the shoe comprising:

a sole structure having a ground engaging surface and a foot engaging surface;

the ground engaging surface having a first planar rear portion and a second forefoot portion extending under the forward portion of a foot of a wearer, the first portion smoothly joining the second forefoot portion along a junction line and being beveled on an angle along the junction," has been deleted and replaced with — and having a thickness tapering from the junction line to a postero-lateral edge of the sole structure to provide a minimum thickness of material interposed between the foot of the wearer and the ground engaging surface and an insole having an initial contact portion in registry with the first planar portion of the support engaging surface and having an insole surface for supporting the foot that has a coefficient of friction that promotes a low shear stress slide of a foot upon impact, the insole having an interface with the foot of the wearer in a medial/forefoot portion of the insole having a higher coefficient of friction than the initial contact portion to resist slippage between the foot and the insole in direction toward the posterior of the shoe.

10. The shoe as in claim 9, wherein the junction line extends from a posterior medial edge of the sole structure to an anterior lateral edge of the sole structure.

* * * * *

UNITED STATES PATENT AND TRADEMARK OFFICE

CERTIFICATE OF CORRECTION

PATENT NO. : 5,586,398

DATED : December 24, 1996

INVENTOR(S) : J. Martin Carlson

It is certified that error appears in the above-indentified patent and that said Letters Patent is hereby corrected as shown below:

Column 10, line 23 after "first" insert --planar--.

Column 10, delete line 26.

Column 10, line 27, delete "--" at the beginning of the sentence.

Column 10, line 31, after "surface" insert --;--.

Signed and Sealed this

Twelfth Day of August, 1997

Bruce Lehman

*Attest:*

BRUCE LEHMAN

*Attesting Officer*

*Commissioner of Patents and Trademarks*